United States Patent [19]

Turner, Jr. et al.

[11] Patent Number: 4,733,785

[45] Date of Patent: Mar. 29, 1988

[54] BUOYANT ADVERTISING STRAW FOR BEVERAGE BOTTLES

[76] Inventors: Dan B. Turner, Jr., 1103 Cary Ave.; Richard Doucet, Jr., P.O. Box 802 (2nd St.), both of Jennings, La. 70546

[21] Appl. No.: 886,834

[22] Filed: Jul. 18, 1986

[51] Int. Cl.[4] ..... B65D 83/00; A47G 21/18

[52] U.S. Cl. ..... 215/229; 215/1 A; 239/24; 239/33

[58] Field of Search ..... 239/33, 24; 206/217; 426/85; 229/75; 220/90.2; 215/1 A, 229

[56] References Cited

U.S. PATENT DOCUMENTS

| | | | |
|---|---|---|---|
| 1,223,933 | 4/1917 | Carr . | |
| 1,253,579 | 1/1918 | Deanes . | |
| 1,309,994 | 7/1919 | McAuliffe . | |
| 1,916,646 | 7/1933 | Tycko . | |
| 2,613,988 | 10/1952 | Jarbeau . | |
| 3,074,610 | 1/1963 | Pugh . | |
| 3,099,565 | 7/1963 | Neuhauser . | |
| 3,291,331 | 12/1966 | Grisham et al. . | |
| 3,326,695 | 6/1967 | Neuhauser . | |
| 3,656,654 | 4/1972 | Brinkley . | |
| 3,780,944 | 12/1973 | Zubalk . | |
| 4,134,494 | 1/1979 | Wong . | |
| 4,252,273 | 2/1981 | Karterman | 239/33 |
| 4,305,521 | 12/1981 | Komatsuta . | |
| 4,379,511 | 4/1983 | del Fabro | 215/1 A |

FOREIGN PATENT DOCUMENTS

| | | | |
|---|---|---|---|
| 1126560 | 11/1956 | France | 215/1 A |
| 471232 | 5/1952 | Italy | 239/33 |

*Primary Examiner*—Kenneth J. Dorner
*Assistant Examiner*—James R. Brittain
*Attorney, Agent, or Firm*—A. Robert Theibault

[57] ABSTRACT

The present disclosure is directed to a beverage container having a tapered neck portion smaller than a buoyant chamber on the container advertising straw having a flexible straw the overall length of which fits from the inside of the container bottom to the inside of the container cap when the cap is seated on the container top. A mini-buoyant chamber in the geometric form of the container in which it is to be placed is on the exterior of the straw. The mini-chamber has an external diameter such as to catch against the inner neck of the beverage container to prohibit accidental separation of the straw from the bottle, but which permits removal of the straw and mini-container from the beverage container by a firm pull, which due to the constriction of the neck, will compress the mini-container from the bottle. An advertising message is on the exterior of the mini-container containing the logo of the bottler which will remain with the straw and mini-buoyant after its disassociation from the bottle.

1 Claim, 7 Drawing Figures

BUOYANT ADVERTISING STRAW FOR BEVERAGE BOTTLES

BACKGROUND OF THE INVENTION

The present invention is directed to beverage straws for use in containers of beverages when shipped wherein the straw contains on its exterior a miniature of the container in which it is shipped with the beverage and wherein the beverage bottler's trademark, logo or other advertising message is printed on the exterior of the miniature container and wherein the straw and mini-container may be removed from the container when the contents have been consumed.

BACKGROUND ART

Beverage bottles containing straws and floats attached thereto within the bottle contents capped for shipment and sale have been known at least since the following patents:

U.S. Pat. No. 1,253,579 S. A. Deanes
U.S. Pat. No. 1,309,994 J. W. McAuliffe
U.S. Pat. No. 3,099,565 R. L. Neuhauser
U.S. Pat. No. 3,326,695 R. L. Neuhauser
U.S. Pat. No. 3,656,654 W. J. Brinkley III
U.S. Pat. No. 4,305,531 H. Komatsuta Other bottles in combination with straws within bottle contents transported in the capped condition are shown in the following patents:

U.S. Pat. No. 2,613,988 C. F. Jarbeau
U.S. Pat. No. 3,291,331 C .R. Brisham et al
U.S. Pat. No. 3,074,610 W. A. Pugh Floats in combination with straws and muddlers for use in beverage glasses are shown in the following patents:

U.S. Pat. No. 1,916,646 S. Tyco
U.S. Pat. No. 4,134,494 W. T. Wong

SUMMARY OF THE INVENTION

None of the art known to us at the time of filling this application for patent teach or suggest the combination of a beverage straw and mini-buoyant chamber in the miniature form of the beverage container in which the beverage, straw, and mini-buoyant container are shipped wherein the mini-buoyant container secured to the straw contains an advertising message during transport, while on sale display in stores, while the beverage is being consumed by the customer and after the straw has been removed from the container. During all these various stages of transport and consumption the mini-buoyant container has beamed the commercial message to all who see it either inside or externally of the bottle even when being played with by a child.

BRIEF DESCRIPTION OF THE FIGURES OF DRAWINGS

THE BEST MODE FOR CARRYING OUT THE INVENTION

Figure 1:
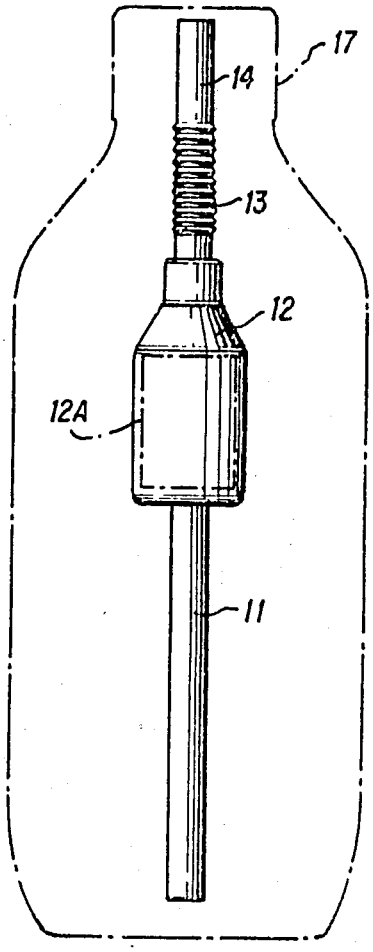
FIG. 1 is a side elevational view of the beverage straw and mini-container for use with a beverage container in accordance with the present invention with a container shown in phantom.

Referring now to FIG. 1, the buoyant straw 10 of the present invention is shown as having a major straw portion 11, having a buoyant chamber 12, generally shaped geometrically in one plane similar to the beverage bottle in which it is transported. The exterior of the buoyant chamber 12 has imprinted thereon at 12A the trademark or logo of the beverage supplier in the same type style as applied to the outside of the bottle or container or other desired advertising printed matter.

Above the buoyant chamber 12 is the known pleated flexure section 13, and drinking portion 14 for introduction into the mouth of the consumer.

Figure 6:
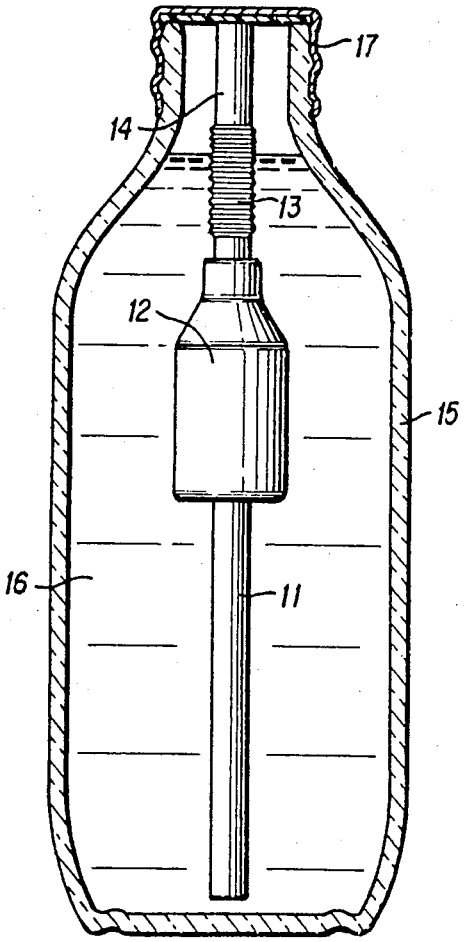
FIG. 6 is a side elevational view of the straw of the present invention shown in a closed beverage container.
Figure 7:
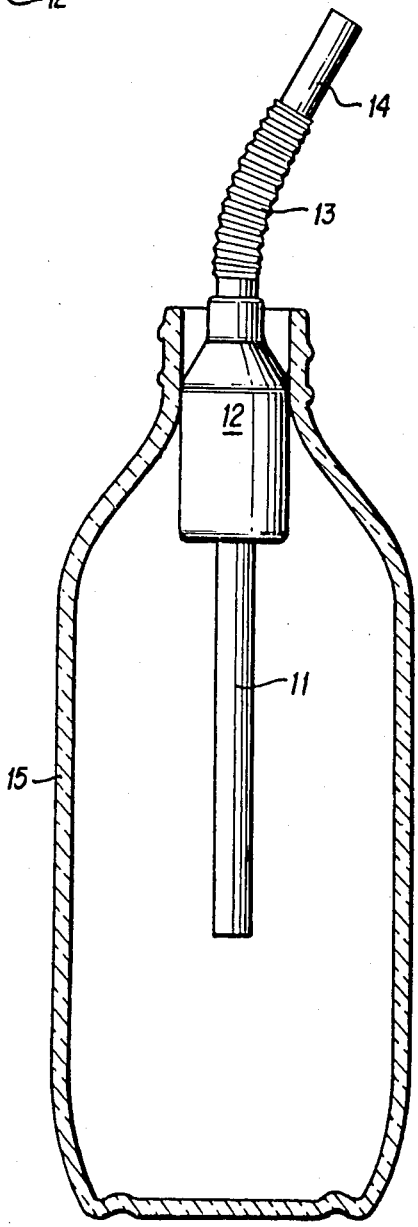
FIG. 7 is a vertical sectional view of a beverage container and straw and mini-container being partially pulled from the container for disassociation therefrom.

As shown in FIG. 6, the buoyant straw 10 is placed into a container 15 having a tampered neck which may be of the non-returnable type, filled with the consumable contents 16 and capped at 17.

The buoyant chamber 12 will be of elliptical cross-section and on the sides on which the logo is placed will be the major axis of the ellipse which will correspond to the bottle shape in one plant to the company's bottle in which it is placed and will correspond with the bottle shape, color and logo.

With the bottle cap 17 on, the buoyant chamber 12, as shown in FIG. 6 starts about $1\frac{3}{4}$ inches from the top of the bottle with the bottom end of the straw 11 against the bottom of the container 15 and the top drinking portion 14 against the cap 17.

When the cap 17 is removed, the straw 10 pops up approximately one inch. By pulling the flex extention 13 the straw extends another one to two inches. The buoyant chamber 12 at its wide section being the major axis of the ellipse will catch at the base of the bottle neck and prevent popping out of the bottle or container 15. As the beverage is consumed the straw will never drop more than the one inch due to hitting the bottom of the container.

Prior to discarding the bottle, a firm pull will release the straw 10 and its attached mini-container 12 from the bottle 15 and whenever and wherever the straw 10 is taken even when used with a conventional glass the advertising logo on the container will continue to beam its message to all observers whether it is in out of a glass.

The straw 10 and buoyant mini-container 12 may be made of conventional pliable plastic straw material known in the art.

The straw 10 may be produced in different measurements to correspond with dimensions of old and new style bottles of different content sizes as can the buoyant mini-bottle 12 which may carry on its exterior any desired advertising message.

Figure 2:
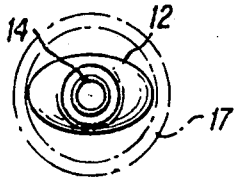
FIG. 2 is a top plan view of the straw and elliptically cross sectional shaped mini-container of FIG. 1.
Figure 3:
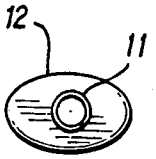
FIG. 3 is a bottom elevational view of straw of FIG. 4.
Figure 4:
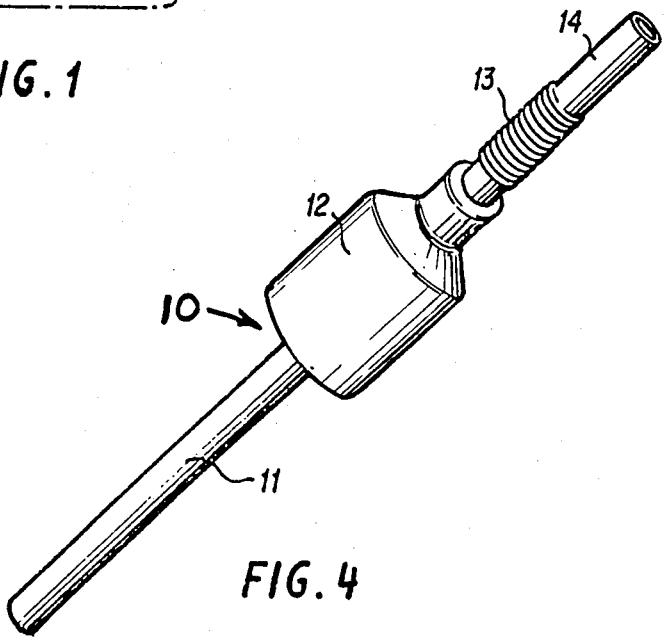
FIG. 4 is a perspective view of a straw and elliptically shaped mini-container constructed in accordance with the present invention.
Figure 5:
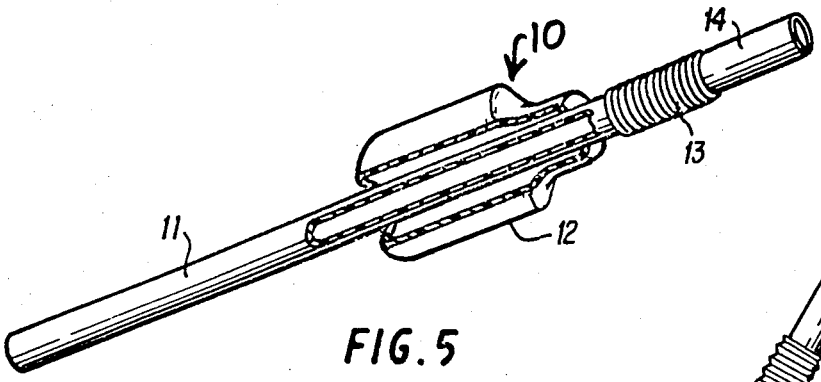
FIG. 5 is a perspective view of the straw and mini-container of FIG. 4, with parts broken away and parts shown in section.

As shown in FIGS. 2 and 3 the elliptical shape of the buoyant mini-container 12 while hugging the internal neck portion of the container 17, shown in dash line at 17 in FIG. 2, will permit insertion of a finger to flex the container 12 to assist its passage through the container neck for withdrawal of the entire straw from the container 15. The elliptical cross sectional shape of the buoyant mini-container will permit flexure of the container by applying finger pressure along the minor axis of the ellipse or at right angles to the major axis of the ellipse.

What we claim is:

1. In combination a consumer beverage container having a cap and a constricted circular cross-sectional opening portion, a consumer beverage drinking straw having a geometrically compressible hollow buoyant miniature of the beverage container external shape in a vertical plane and having a horizontal elliptical cross-section secured about the entire exterior of the straw and being compressible by and for passage through the container constricted opening and which once inside the container expands to a size as to not accidentally pass freely through the container opening without applying and axial pulling force on the straw which due to the constriction of the container opening will compress the hollow buoyant miniature container permitting withdrawl of the straw and mini container from the beverage container, and an advertising message on the exterior of the mini container defining the geometric form and portion of the logo of the beverage processor of the container in which the hollow mini container and straw was supplied to a consumer.

* * * * *